US006725923B1

(12) United States Patent
Ivannikov et al.

(10) Patent No.: US 6,725,923 B1
(45) Date of Patent: Apr. 27, 2004

(54) METHOD AND DEVICE FOR EXCITING TRANSVERSAL OSCILLATIONS OF A PIPE STRING IN A BOREHOLE

(75) Inventors: Vladimir Ivanovich Ivannikov, Moscow (RU); Ivan Vladimirovich Ivannikov, Moscow (RU)

(73) Assignee: BIP Technology Ltd., Limassol (CY)

( * ) Notice: Subject to any disclaimer, the term of this patent is extended or adjusted under 35 U.S.C. 154(b) by 0 days.

(21) Appl. No.: 10/129,607

(22) PCT Filed: Nov. 9, 2000

(86) PCT No.: PCT/RU00/00450

§ 371 (c)(1),
(2), (4) Date: May 8, 2002

(87) PCT Pub. No.: WO01/34937

PCT Pub. Date: May 17, 2001

(30) Foreign Application Priority Data

Nov. 10, 1999 (RU) ..... 99123968

(51) Int. Cl.[7] ..... E21B 28/00
(52) U.S. Cl. ..... 166/249; 166/177.6; 166/286
(58) Field of Search ..... 166/249, 286, 166/177.6, 178, 301

(56) References Cited

U.S. PATENT DOCUMENTS 3,923,099 A * 12/1975 Brandon ..... 166/249
5,273,114 A 12/1993 Wicks, III et al. ..... 166/278
5,282,508 A * 2/1994 Ellingsen et al. ..... 166/249
5,439,290 A 8/1995 Wicks, III et al. ..... 366/241
5,836,389 A * 11/1998 Wagner et al. ..... 166/249

FOREIGN PATENT DOCUMENTS

RU 2049912 12/1995
RU 2093664 10/1997

OTHER PUBLICATIONS

International Search Report. (Mar. 2001).

* cited by examiner

*Primary Examiner*—Zakiya Walker
(74) *Attorney, Agent, or Firm*—Collard & Roe, P.C.

(57) ABSTRACT

Method and devices for freeing stuck pipes in wells in the absence of circulation or intensifying of inflow of fluids from a productive rock, for cleaning plugged well screens, and for improving quality of cementing of casing pipes in wells. Transverse vibrations are excited in a column of tubes in the well by axial motion of a hammer or hammers suspended inside the column of tubes on a flexible suspension support. The hammers have a maximum cross-section which is 0.90–0.98 times the inner diameter of the tubes. The hammers oscillate in a radial direction and hit the wall of tubes when the flexible suspension is pulled, thus exciting transverse vibrations in the column of tubes. The strength and repetition rate of hits can be varied depending on the speed of axial motion of the hammers, weight of a load placed under the hammers, number or shape of the hammers, spacing between the hammers, and the density or viscosity of a liquid filling the well.

31 Claims, 2 Drawing Sheets

METHOD AND DEVICE FOR EXCITING TRANSVERSAL OSCILLATIONS OF A PIPE STRING IN A BOREHOLE

Applicants claim priority under 35 U.S.C. §119 of Russian Application No. 99123968 filed Nov. 10, 1999. Applicants also claim priority under 35 U.S.C. §365 of PCT/RU00/00450 filed Nov. 9, 2000. The International application under PCT article 21(2) was not published in English.

BACKGROUND OF THE INVENTION

1. Field of the Invention

This invention relates to boreholes technologies in connection with drilling and exploitation of wells and can be particularly used to intensify inflow of fluids from ambient rock, cleaning of the wells screens, and also to free stuck pipes in well and improving quality of cementing of casing pipes in wells.

2. Prior Art

A method and device are known for exciting transverse oscillations of pipes in wells via placing in the main column string of an additional column of smaller diameter, which is equipped along its perimeter with edges of equal size. When rotating that additional column its edges produce hits causing the transverse vibrations of the main column string (SU 734386, May 15, 1980).

General shortcomings inherent to this known technical solution are the following:

1. Big size of equipment to implement the method;
2. Insufficient effectiveness because of high level of energy consumption and low repetition rate of produced hits;
3. Inability to produce oscillations in a liquid filling a well, i.e. to effect the rock in the zone of column perforation via the liquid (only agitating of the liquid occurs).

Also a method is known for exciting transverse oscillations of a pipe string in a well comprising placement into a pipe string filled with a liquid of a hammer on a flexible suspension support and exciting of its radial periodical oscillations followed by transferring of transverse high frequency hits on the pipe string (U.S. Pat. No. 5,273,114; Dec. 15, 1993), which method is the closest technical solution to the proposed one.

A device is known for exciting transverse oscillations of a pipe string in a well comprising a string of pipes partially or fully filled with a liquid, a hammer placed in the said pipe string and a limiter of axial motion of the said hammer made in a form of a flexible suspension support, one end of which is connected with the said hammer (U.S. Pat. No. 5,273,114; Dec. 15, 1993).

The following can be referred to as shortcomings of the said solutions:

1. Source of vibrations—hammer is connected to the point located in the pipe string. Because of that the transverse oscillations that are locally excited in the column are attenuated as distance is increased from this location;
2. The hammer operates only if a liquid is pumped through while the conditions can take place in a well when it is not possible to circulate liquid, for example, during a stuck pipe when running a casing pipe or after injecting and squeezing of a cement or during effecting on a productive rock when it is not advisable to fill the well with a liquid to avoid killing of oil inflow, and in some other cases;
3. Possibilities to control the parameters of oscillations are believed to be insufficient;
4. Necessity to employ special pumping equipment with high consumption of power.

SUMMARY OF THE INVENTION

Technical effect, what is the eliminating of the said shortcomings, can be achieved by that in the method for exciting of transverse oscillations of a pipe string comprising a placing of a hammer into a pipe string filled with a liquid and exciting of its radial periodic vibrations and transfer of transverse hits to the said pipe string, wherein the said hammer is made to provide ratio of its maximal cross-section to inner transverse cross-section of the string within the limits of 0.9–0.98 and it is placed into the pipe string on a flexible suspension support, and radial periodical vibrations of the hammer are produced due to its axial motion within the said string at a speed to be selected from a condition of a pulling force applicable on a support which is determined experimentally.

Additionally:

Strength of hits transferred to the string is controlled by a weight suspended under the hammer on a flexible suspension support;

Strength of hits transferred to the string is controlled by a number of hammers placed under each other on a flexible suspension supports;

Strength of hits transferred to the string is controlled by viscosity of a liquid filling the pipe string;

Strength of hits transferred to the string is controlled via different filling of the liquid in the pipe string with gaseous phase;

Strength and repetition rate of hits transferred to the string are controlled by acceleration of the hammer motion;

Strength and repetition rate of hits transferred to the string are controlled due to parametric gain of oscillations of the hammer;

Strength and repetition rate of hits transferred to the string are controlled by changing of a clearance between the hammer and internal transverse cross-section of the pipe string;

Strength and repetition rate of hits transferred to the string are controlled by variation of shape of the hammers;

Strength and repetition rate of hits transferred to the string are controlled by changing of a distance between the hammers in the garland.

Also:

The hammer is being moved with such a speed that result in rupture of continuity of column of a liquid filling the pipe string.

Regime of oscillations of the hammer is controlled at mouth of the well by tension of the flexible suspension support.

In the proposed device the required technical effect is achieved due to that in this device comprising a string of pipes partially or fully filled with a liquid, a hammer placed in the said pipe string and a limiter of axial motion of the said hammer, wherein the said hammer is made to provide ratio of its maximal cross-section to inner transverse cross-section of the said pipe string within the limits of 0.9–0.98 and said limiter of axial motion of the said hammer is made in a form of a flexible suspension support one end of which is fastened at the mouth of the well and the another end is connected with the said hammer.

Additionally:

A weight is suspended on a flexible suspension support under the hammer;

The hammer is made in a form of a garland of hammers placed under each other on a flexible suspension supports;

The hammer is made in a form of a ball;

The hammer is made in a form of a cylinder;

The hammer is made in a form of a cone;

The hammer is made in a form of a cylinder and a hemisphere connected to it;

The hammer is made in a form of a cone and a hemisphere connected to it;

The hammer is made in a form of a ball and a hemisphere connected to it;

The hammers in the garland are made different by mass;

The hammers in the garland are placed equidistantly;

The hammers in the garland are placed non equidistantly;

The hammers in the garland are of the same shape;

The hammers in the garland are of the different shapes;

The hammer is made hollow and its inner cavity is filled with a liquid having density of 1–13.6 grams/cub.cm;

The hammer is made hollow and its inner cavity is partially filled with a liquid having density of 1–13.6 grams/cub.cm;

The pipe string is fully or partially filled with a liquid having density of 1–13.6 grams/cub.cm;

The pipe string is fully or partially filled with the liquids having different densities;

The pipe string is fully or partially filled with the liquids having different viscosity.

The nature of criteria defining the originality of the proposed method can be proved by the following:

making of a hammer to provide ratio of its maximal cross-section to inner transverse cross-section of the string within the limits of 0.9–0.98 is based on that if this ratio is less than 0.9, the hammer turns to rotating along the pipe axis (it rolls on the pipe wall). It was revealed during laboratory studies and immediately in the wells and can be explained by specifics of pressure distribution in semi moon-like clearance. If the ratio is 0.9–0.98 the clearance becomes more uniform by width thus resulting in that the pressure distribution in the flow passing over the hammer becomes more uniform and the hammer changes over to regime of transverse vibrations (it was also observed at the lab setup);

selection of a flexible suspension support follows from that it practically doesn't restrict freedom of radial motion of the hammer;

speed of axial motion of the hammer is selected from a condition of that a pulling force on a suspension support which is a function of the hammer mass, number of hammers in assembly, clearance between the hammer and inner cross-section of the pipe, viscosity of the liquid in the pipe, acceleration of axial motion of the hammer, and it is derived empirically.

It can be necessary to control strength of hits transferring to the pipe string to increase or reduce vibroaction. Increase of it can be required in case of a strong stuck pipe (for example, stuck pipe during running down of a casing pipe, e.g. due to a borehole wall arching in intervals of plastic clays occurrence). Reducing of it can be required during cementing of the casing pipe at a stage of initial cement setting.

Controlling of the hits strength is provided due to placing below the hammer of a weight on a flexible suspension support. The small amplitude disturbing axial oscillations of the suspended weight being excited during motion of the hammer upwards result in parametric gaining or attenuation of transverse vibrations of the hammer.

Placement below the hammer of additional (similar) hammers on a flexible suspension support allows to increase repetition rate of hits transferred to a pipe string and also to increase amplitude of the pipes vibration. In this case also an opportunity appears for parametric gaining of the hammers oscillations because variation of speed of lifting of the garland of hammers leads to a condition when initially small transverse oscillations will grow by amplitude (the phase correlation required for that will be self-settled). It is a phenomenon similar to effect of a resonance. The oscillations of the hammers will be stabilized then and strength of hits transferred to the pipe string will grow.

Another parameter to control the frequency of the hammers oscillations is the clearance between the pipe string and a hammer. As the clearance grows (within the specified limits of the ration between cross-sections of the pipe string and the hammer) the repetition rate of hits reduces and vise versa.

In practice the parametric resonance of this system (garland of hammers) can be controlled by tension of a suspension support (pull rope of a winch). When oscillations in the system run into resonant state the tension of the flexible suspension support (pull rope) dramatically increases. It can be detected instrumentally, for example, by a logger.

Similarly, one can detect the rupture of continuity of a liquid column in the pipe string due to that a further increasing of speed of lifting of a garland of hammers results in that the tension of the pull rope additionally grows and abrupt variations of this tension appear resulted from said rupture of the liquid continuity.

Axial motion of the hammer in some cases can be enabled at a constant speed, e.g. during regular works such as during cementing of a casing pipe when the hammering system is run along the whole length of the pipe string after cement squeeze into the annulus. It prevents thickening of the cement-water slurry and allows to reduce its viscosity by 2–3 orders of magnitude (N. B. Uriev, N. V. Mikhailov, Rheological properties of cement-water slurries under vibrations, Reports of USSR Academy of Sciences, 1963, Vol. 153, No. 4, p. 828–831). However is non-standard cases of sticking of a drilling or casing pipe in a well the parameters of the oscillation system are often to be selected experimentally by varying of the hitting action on the pipe string within certain limits. In such cases a speed of axial motion of the hammer is to be varied or alternating reverse motion and pulling up by a suspension support to be used.

In other cases it could be necessary to reduce the hitting action on a pipe string, for example, on a cemented casing pipe not to destroy the cement stone in the annulus. It can be done due to priory filling of the well with a liquid having higher viscosity. If a liquid is used having viscosity equal to viscosity of glycerin, the hitting action can be reduced by 60–80%.

The above explanations for the proposed inventive method can be also applied to the features that relate to the device as it is claimed in claims 13–15. According to the claims 16–21 the hammer can be made in a form of a ball, cylinder, cone or their combinations. The most suitable and technological one is expected to be a hammer in the form of a ball. However making of hammer in the form of a cylinder or cone or any derivative form of them will enable stronger disturbing of liquid in a well and, therefore, the changing behavior of the hammer when pulling it axially. It is important not only for a single hammer, but for a garland of hammers also, especially if the works are intended to treat the rock. Such treatment can be provided at speed of pulling sufficient to cause rupture of continuity of a liquid column. The ruptures of the liquid in the pipe string result in formation of cavitation cavities, imploding of which causes sucking of fluid from the rock and generates shock waves. It enables decolmatating of the productive rock, cleaning of screens and micro hydrofracturing in a bottomhole zone, what eventually result in folded growth of productivity of the wells by debit of the rock fluids, particularly, oil and gas.

When placing of some hammers in the zone of hydraulic interaction with the others, the parameters of the oscillation system change. Due to selection of different designs of the hammers and their placing in respect to each other, one can enable various resonant oscillations in different conditions.

BRIEF DESCRIPTION OF DRAWINGS

The proposed method for exciting transverse oscillations of a pipe string in a well can be illustrated by several examples.

Figure 1A:
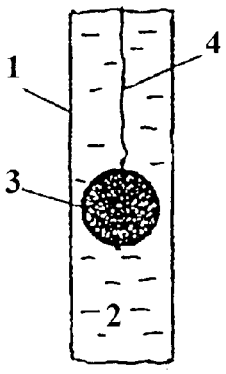
FIG. 1*a*–FIG. 1*h* show variants of hammers assemblies.
Figure 1B:
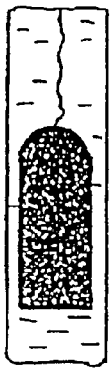
Figure 1C:
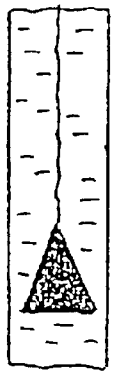
Figure 1D:
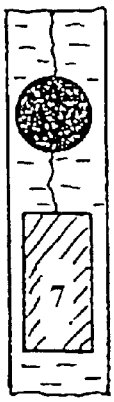
Figure 1E:
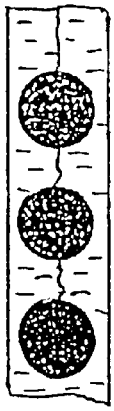
Figure 1F:
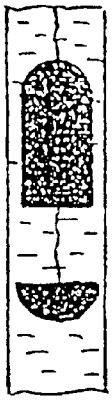
Figure 1G:
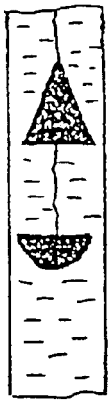
Figure 1H:
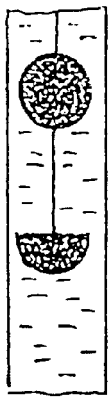

Embodiment of the proposed inventive method comprises a pipe string 1 fully or partially filled with a liquid 2. Inside the pipe string 1 a hammer 3 is placed, for example, a ball. It is made to have a transverse cross-section (diameter) constituting a ratio to an inner transverse cross-section of the string within the limit of 0.9–0.98. The hammer 3 has a limiter of its axial motion that is made in a form of a flexible suspension support 4. One end of the flexible suspension support 4 is connected to the hammer 3, and another is connected at the mouth of the well 5, for example, connected to a logger 6. On a flexible suspension support below the hammer 3 a weight 7 is suspended.

DETAILED DESCRIPTION OF THE INVENTION

Figure 2A:
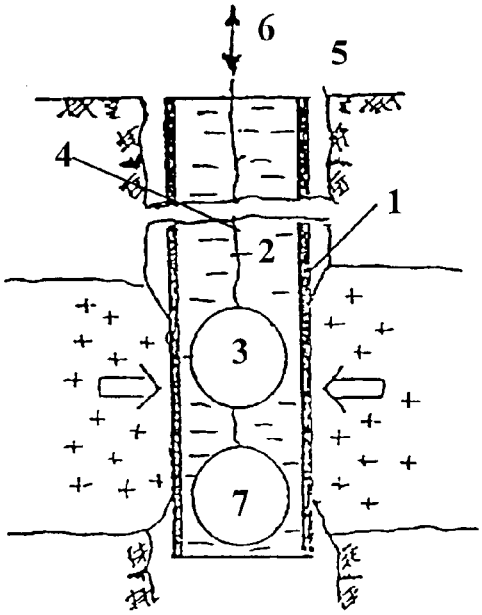
FIG. 2*a*–FIG. 2*d* show variants of the device in a form of a garland of equal balls.

The device operates as follows:

To free a stuck pipe the hammer is run, for example, into a casing pipe filled with a liquid (e.g. drilling fluid) to a location of the sticking (FIG. 2*a*). After that the hammer is reciprocally moved up and down for a length of stuck pipes. When the moving hammer (for example, a ball) is flowed over with the liquid the pressure in clearance between it and pipe drops and the hammer hits the pipe wall. The pipe gets a radial displacement and frees from the sticking. To make the hit pulses stronger when the hammer is pulled upwards, such a speed is determined when a parametric resonance takes place in the system what can be detected by tension of the flexible suspension support of a winch.

Figure 2C:
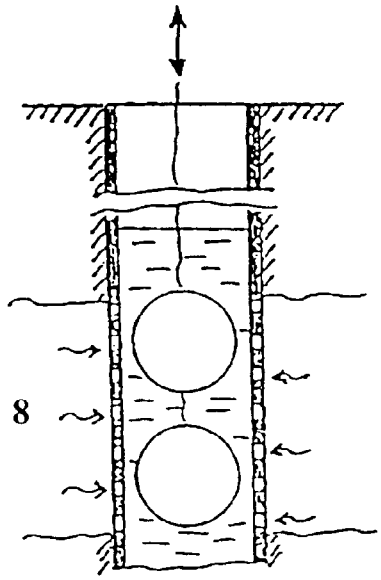
Figure 2B:
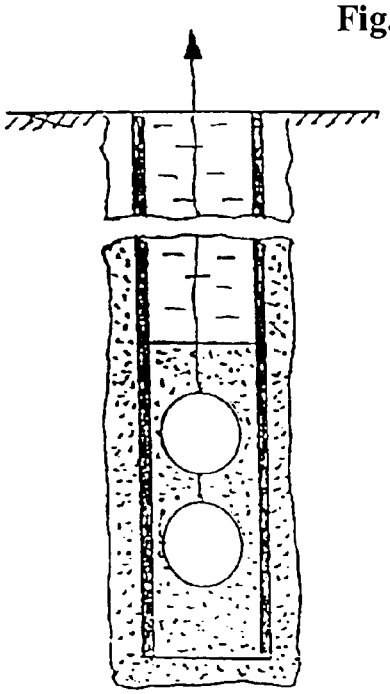

To vibrationally treat the cement mud (FIG. 2*b*) the hammer is run into a casing pipe on a rope till it reaches the string shoe. Concurrently with cement squeezing and driving it into the annulus of the well the garland hammer is pulled upwards. The hammer creates the high frequency vibrations of the pipe string which are applied to the upflow of the cement slurry thus reducing its viscosity and avoiding thickening and earlier setting of it. Running the hammer up and down in this case is provided through a lubricator.

To clean a screen or perforations zone of an exploitation tubing (FIG. 2*c*) the hammer is run into interval of penetration into productive rock below level of liquid and then it is reciprocally moved up and down by a winch. It results in that the hammer generates mechanical hits and hydraulic pulses, which provide cleaning of the screen and bottom hole zone of the rock from colmatants and thus eliminate the skin effect and restore permeability of the bottomhole rock.

Figure 2D:
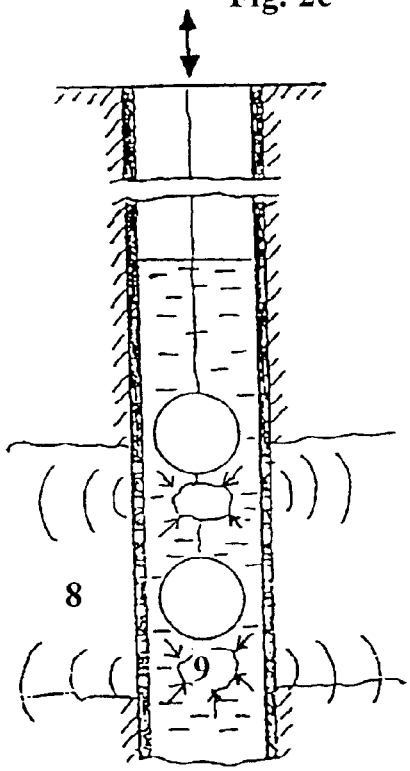

To treat a rock (FIG. 2*d*) the hammer is run into exploitation tubing string and placed within interval of perforation. After that the garland is abruptly pulled up with acceleration to cause a rupture of continuity of the liquid column beyond the elements of the hammer. When thus produced cavities in liquid implode, the shock waves are generated which mediate action on the rock. The result of this action, as practical experience shows, is increasing of inflow or intake capacity of, for example, oil wells.

EXAMPLE OF EMBODIMENT

The casing pipe of 324 mm by diameter were stuck in a well at depth of 224 m because of arching of the permafrost rocks. Attempts to pace the pipe forth and back had no success. It was not possible to circulate liquid in the well to wash the annulus. To free the stuck pipe a garland comprising two equal balls of 300 mm by diameter and connected by a chain was run into it using a logger winch. Taking into consideration weight reduction due to immersion into a drilling fluid with gravity of 1.2 grams/cub.cm their weight constituted 560 kg. When lifting the hammer with speed of about 1 m/sec it parametrically oscillates and transfers to the pipe string the periodical hits at repetition rate of about 8 hits per second. After three runs of the hammer up and down within interval of 60 m along location of the sticking the pipe was freed and then was run into projected depth.

What is claimed is:

1. A method for exciting transverse vibrations of a pipe string partly or fully filled with one or more liquids or fluids, the method comprising:

placing one or more hammers on a flexible suspension support into the pipe string; and exciting periodic radial oscillations in said one or more hammers resulting in said one or more hammers transversely hitting said pipe string;

wherein said one or more hammers are made to provide a ratio of their maximum cross-section to an inner transverse cross-section of the pipe string within a limit of 0.9–0.98; and wherein said periodic radial oscillations of said one or more hammers are produced due to an axial motion of said one or more hammers in said pipe string and a speed of said axial motion is selected to produce a hit of required strength.

2. The method according to claim 1, wherein a strength of hits transferred to the pipe string is controlled by a weight of a load placed under said one or more hammers on said flexible suspension support.

3. The method according to claim 1, wherein a strength of hits transferred to the pipe string is controlled by a number of hammers placed under each other on said flexible suspension support.

4. The method according to claim 1, wherein a strength of hits transferred to the pipe string is controlled by a viscosity of the liquid filling the pipe string.

5. The method according to claim 1, wherein a strength of hits transferred to the pipe string is controlled by filling of the liquid in the pipe string with a gas phase.

6. The method according to claim 1, wherein a strength and a repetition rate of hits transferred to the pipe string are controlled by an acceleration of the motion of said one or more hammers.

7. The method according to claim 1, wherein a strength and a repetition rate of hits transferred to the pipe string are controlled by a parametric gain of oscillations of said one or more hammers.

8. The method according to claim 1, wherein a strength and a repetition rate of hits transferred to the pipe string are controlled by changing a clearance between said one or more hammers and an inner transverse cross-section of the pipe string.

9. The method according to claim 1, wherein a strength and a repetition rate of hits transferred to the pipe string are controlled by varying a shape of said one or more hammers.

10. The method according to claim 1, wherein a strength and a repetition rate of hits transferred to the pipe string are controlled by varying a distance between said one or more hammers placed under each other on the flexible suspension support.

11. The method according to claim 1, wherein said axial motion of said one or more hammers is provided at a speed that results in a rupture of continuity of a column of the liquid filling the pipe string.

12. The method according to claim 1, wherein a regime of oscillations of said one or more hammers is controlled at a mouth of a well by a tension of said flexible suspension support.

13. A device for exciting transverse vibrations of a pipe string partly or fully filled with one or more liquids or fluids, the device comprising:

one or more hammers placed in the pipe string; and a limiter of axial motion of said one or more hammers;

wherein said limiter comprises a flexible suspension support; and wherein one end of said flexible suspension support is connected to said one or more hammers; and wherein another end of said flexible suspension support is fastened at a mouth of a well to enable axial motion of said one or more hammers in said pipe string; and wherein said one or more hammers placed in the pipe string are made to provide a ratio of their maximum cross-section to an inner transverse cross-section of said pipe string within a limit of 0.9–0.98.

14. The device according to claim 13, wherein a weight is suspended on said flexible suspension support under said one or more hammers.

15. The device according to claim 13, wherein said one or more hammers comprises a garland of hammers placed under each other on said flexible suspension support.

16. The device according to claim 15, wherein said one or more hammers comprising said garland are placed equidistantly.

17. The device according to claim 15, wherein said one or more hammers comprising said garland are placed non-equidistantly.

18. The device according to claim 15, wherein said one or more hammers comprising said garland have a same shape.

19. The device according to claim 15, wherein said one or more hammers comprising said garland have a different shape.

20. The device according to claim 15, wherein said one or more hammers comprising said garland have a different mass.

21. The device according to claim 13, wherein said one or more hammers comprise a ball.

22. The device according to claim 13, wherein said one or more hammers comprise a cylinder.

23. The device according to claim 13, wherein said one or more hammers comprise a cone.

24. The device according to claim 13, wherein said one or more hammers comprise a cylinder with a hemisphere connected to said cylinder.

25. The device according to claim 13, wherein said one or more hammers comprise a cone with a hemisphere connected to said cone.

26. The device according to claim 13, wherein said one or more hammers comprise a ball with a hemisphere connected to said ball.

27. The device according to claim 13, wherein said one or more hammers are hollow and have an inner cavity filled with a liquid having a density of 1–13.6 grams/cubic cm.

28. The device according to claim 13, wherein said one or more hammers are hollow and have an inner cavity partly filled with a liquid having a density of 1–13.6 grams/cubic cm.

29. The device according to claim 13, wherein the pipe string is fully or partially filled with a liquid having a density of 1–13.6 grams/cubic cm.

30. The device according to claim 13, wherein the pipe string is fully or partially filled with a plurality of liquids having different densities.

31. The device according to claim 13, wherein the pipe string is fully or partially filled with a plurality of liquids having different viscosities.

* * * * *